United States Patent [19]

Retka et al.

[11] 4,023,645

[45] May 17, 1977

[54] METHOD AND APPARATUS FOR REDUCING AERODYNAMIC WHISTLE

[75] Inventors: Thomas J. Retka, Lakeville; Wayne M. Wagner, Apple Valley, both of Minn.

[73] Assignee: Donaldson Company, Inc., Minneapolis, Minn.

[22] Filed: Feb. 27, 1975

[21] Appl. No.: 553,558

[52] U.S. Cl. ..... 181/48; 181/35 C; 181/59

[51] Int. Cl.[2] ..... F01N 1/00

[58] Field of Search ..... 181/35 C, 47, 48, 49, 181/56, 57, 59, 63, 69

[56] References Cited

UNITED STATES PATENTS

| | | | |
|---|---|---|---|
| 879,583 | 2/1908 | Pratt | 181/57 |
| 1,173,583 | 2/1916 | Johnston | 181/57 |
| 2,034,686 | 3/1936 | Lattner | 181/69 |
| 2,047,443 | 7/1936 | Starkweather | 181/59 |
| 2,311,676 | 2/1943 | Maxim | 181/55 |
| 2,576,522 | 11/1951 | Kiffin | 181/59 |
| 2,618,353 | 11/1952 | Hedrick | 181/59 |
| 3,106,984 | 10/1963 | Carter | 181/57 |
| 3,209,861 | 10/1965 | Whitney | 181/59 |
| 3,315,761 | 4/1967 | Selig | 181/35 C |
| 3,415,338 | 12/1968 | McMillan | 181/59 |
| 3,952,590 | 4/1976 | Howard et al. | 73/147 |

*Primary Examiner*—Robert K. Schaefer
*Assistant Examiner*—Vit W. Miska
*Attorney, Agent, or Firm*—Merchant, Gould, Smith, Edell, Welter & Schmidt

[57] ABSTRACT

Means and methods for prevention of undesirable acoustical whistles in mufflers or silencers of inexpensive and convenient design are shown. The broad inventive concept is that of preventing extended smooth flow of gas within a perforated tube, and this is taught by regular or random beading, by internal banding, or by provision of a screen structure for insertion within the tube.

5 Claims, 9 Drawing Figures

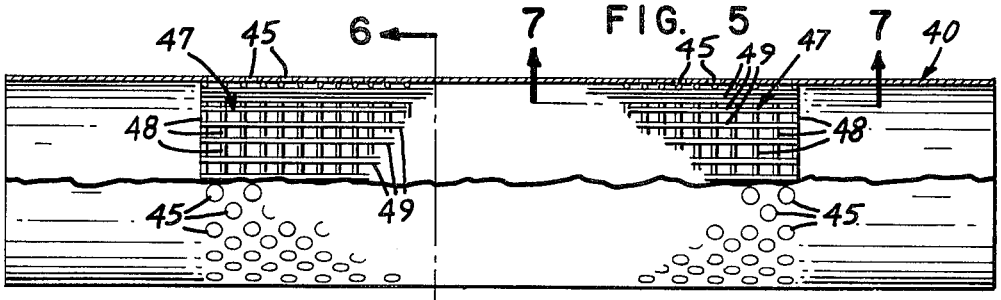
FIG. 5
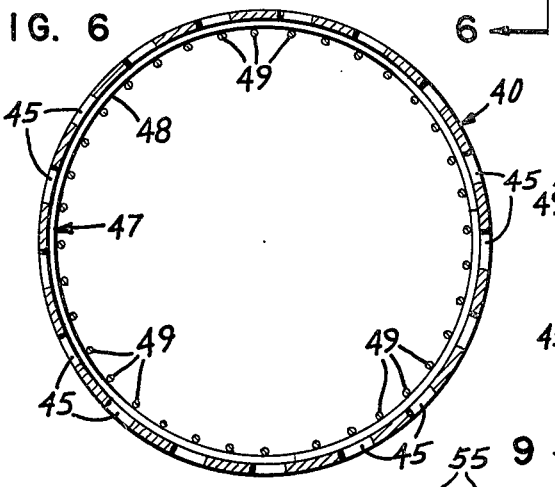
FIG. 6
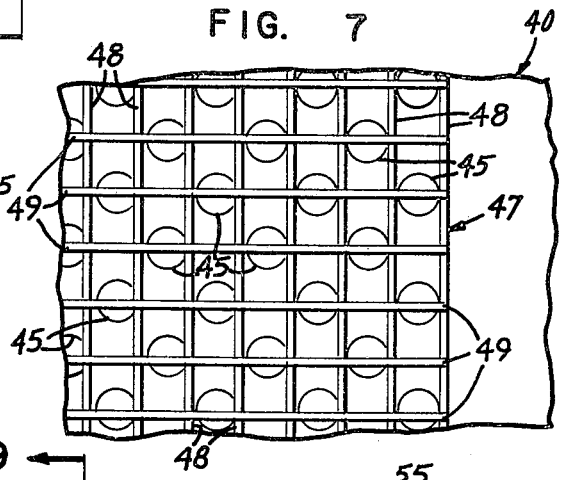
FIG. 7
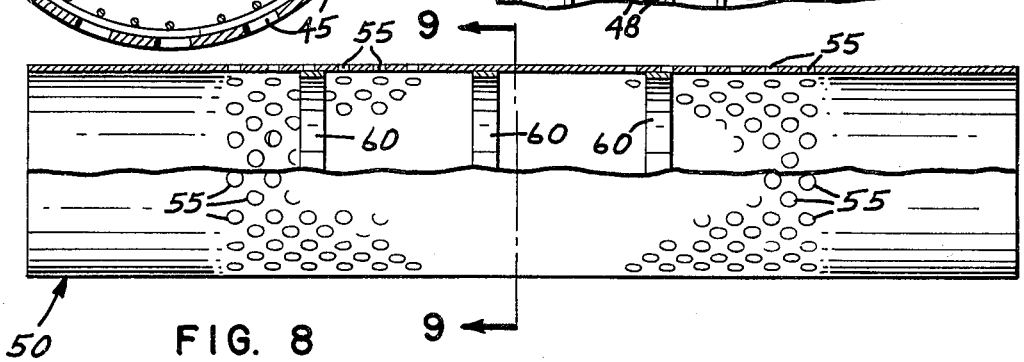
FIG. 8
FIG. 9
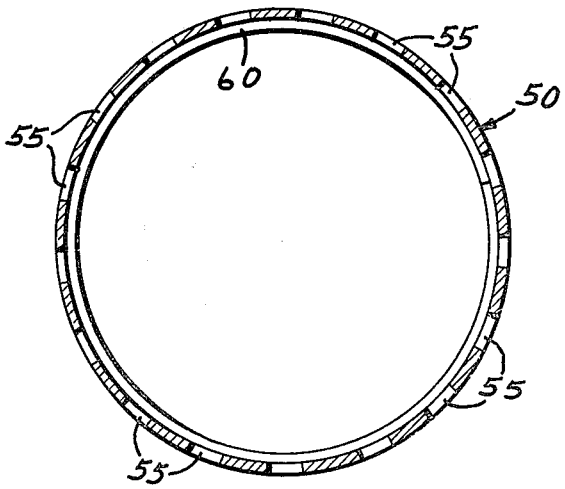

METHOD AND APPARATUS FOR REDUCING AERODYNAMIC WHISTLE

BACKGROUND OF THE INVENTION

This invention relates to the field of acoustics, and more particularly to means for attenuating the acoustical component of the energy of a flowing gas. Devices for this purpose are known as mufflers or silencers, and numerous types thereof are known. A type of primary interest here is that in which the gas flows through a passage or tube coupled by a field of small apertures with one or several resonating chambers, each chamber being designed to attenuate acoustical energy in a predetermined frequency range.

From a constructional point of view, the most desirable structure of this sort is a simple inner tube having a field of sharp edged, round, regularly positioned perforations. The perforations can be punched while the metal is flat by a simple line of inexpensive punches, in one or two passes through the punch depending upon whether the perforations are to be in-line or staggered, the tube can thereafter be completed by rolling or forming and welding, and there is nothing to prevent the completed tube from sliding into any appropriately sized circular orifice in a muffler baffle or core, or to prevent appropriately sized circular members from being inserted into the tube, as any special demands of an application may require. The structure is rigid, durable, and resistant to high temperature and to plugging of the holes by particulate matter in the gas.

It has been found, however, that mufflers of this sort generate annoying whistling sounds, which in extreme cases may be of greater intensity than the broad-band sounds which are intended to be attenuated, and may lie within the design attenuation band.

SUMMARY OF THE INVENTION

The present invention comprises means for avoiding such whistles, while retaining the advantages of the simple structure. This is accomplished by providing means adjacent to or incorporated in the wall of the passage or tube for preventing smooth flow of the gas directly past a considerable sequence of the perforations. It is believed that the resulting enturbulation of gas flow prevents small amplitude oscillations in the individual perforations from coupling mutually in feedback fashion to give an amplified oscillation of objectionable amplitude. In any case, it has been found that insertion of a wire screen liner or a series of sheet metal rings, or provision of a plurality of inward beads spaced regularly or randomly along the tube and extending completely or partially around the tube in random pattern, operates to reduce the whistles to acceptable levels.

Various advantages and features of novelty which characterize our invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

BRIEF DESCRIPTION OF THE DRAWING

In the drawing,

FIG. 5 is a view like FIG. 3 of another embodiment of the invention;

FIG. 6 is a transverse sectional view taken along the line 6—6 of FIG. 5;

FIG. 7 is a fragmentary view seen in the direction 7—7 of FIG. 5;

FIG. 8 is a view like FIG. 3 showing a further embodiment of the invention; and

FIG. 9 is a transverse section taken along the line 9—9 of FIG. 8.

DESCRIPTION OF THE PREFERRED EMBODIMENTS

Figure 1:
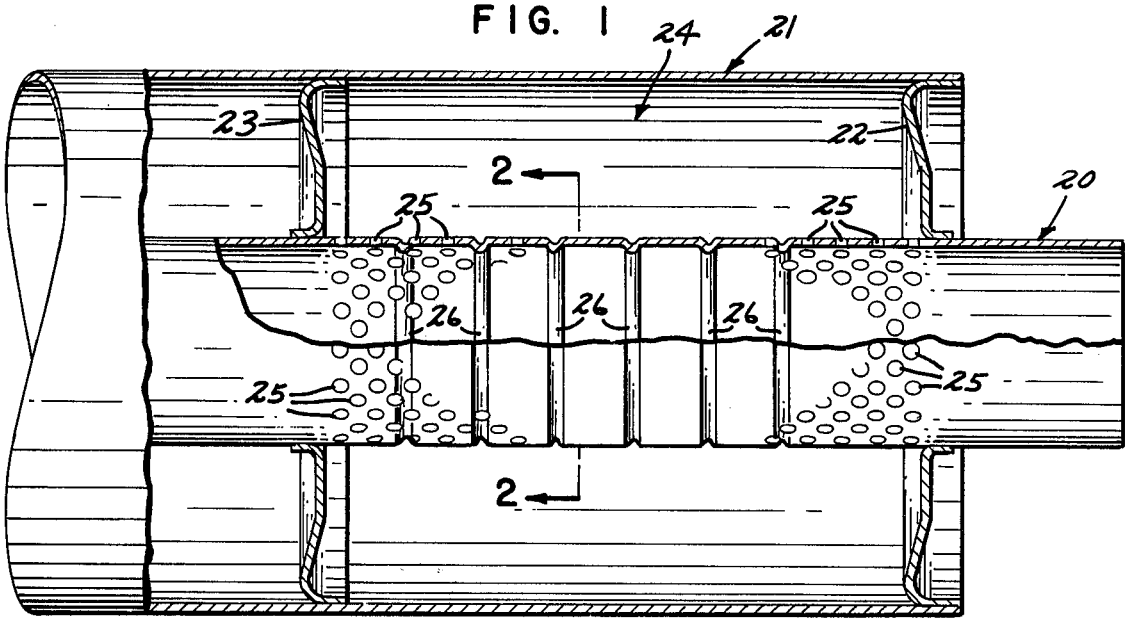
FIG. 1 is an elevation of a portion of a muffler showing a first embodiment of the invention, parts being broken away for clarity.

Turning now to FIG. 1, a portion of a muffler or silencer according to the invention is shown to comprise an inner gas flow tube or passage 20, connected to an outer tube 21 by a pair of baffles 22, 23 to which the tubes are welded or otherwise suitably secured. The inside of tube 20 comprises a gas flow passage which offers relatively low resistance to fluid flow, and, hence, presents only slight back pressure to an engine, for example, whose exhaust gas contains a component of acoustical energy to be removed. The space between tubes 20 and 21 and baffles 22 and 23 is designed as a resonating chamber 24 for the attenuation of acoustical energy in a predetermined band, and may be one of several such chambers having different design frequency bands and located along tube 20. The wall of the passage formed by tube 20 is provided with a field of sharp edged perforations 25 which provide acoustical connection between the passage and the chamber. In a typical device of this kind, the inner tube was 4.02 inches in inside diameter, of 16 gauge material: the holes were round, ¼ inch in diameter, arranged in 40 staggered circumferential rows of 17 holes per row, so that the field extended for 12 inches along the tube and occupied 17% of the tube area. Chamber 24 was 12 inches long and 6 inches in internal diameter, to deal with a band of frequencies in the audible range extending between 20 and 20,000 hertz. The structure just described is known to generate severe whistles, of which the number intensity and frequency of principal components vary when the flow through the tube is varied.

Figure 2:
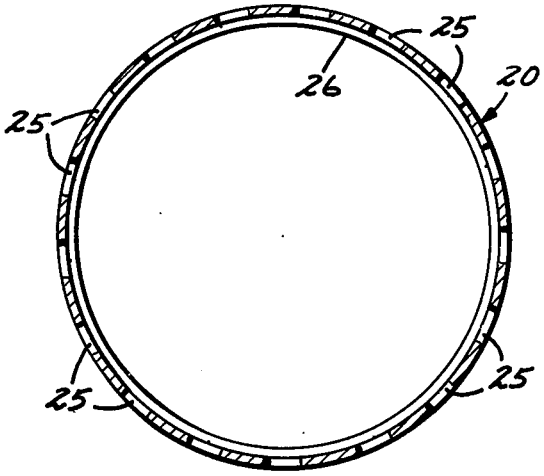
FIG. 2 is a transverse section taken along the line 2—2 of FIG. 1.

As is shown in FIGS. 1 and 2, the wall of tube 20 is formed with a plurality of inward beads 26 which extend completely around the tube and are spaced axially therealong. In one embodiment of the invention, the beads were 0.06 inches deep by 0.09 inches wide, and were spaced 1.5 inches along the tube: a second similar embodiment with beads spaced 3.0 inches was also found to be satisfactory. No attempt was made to have the beads fall between rows of perforations, and there is apparently no necessity for the beads to be uniformly spaced axially.

Figure 4:
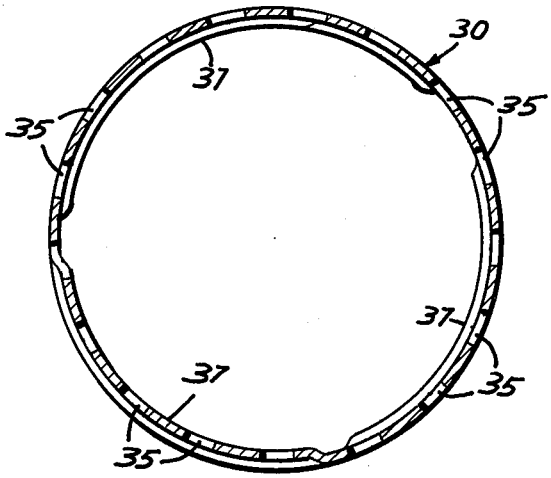
FIG. 4 is a transverse sectional view taken along the line 4—4 of FIG. 3.
Figure 3:
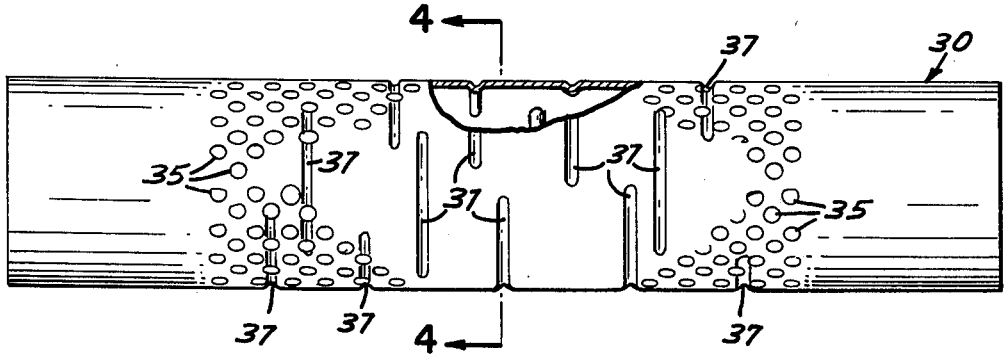
FIG. 3 is an elevation of a second embodiment of the invention, a portion being broken away.

FIGS. 3 and 4 show a modification of the invention in that the tube 30 including perforations 35 has beads 37 which are not continuous around the tube, but extend for about 120° therearound. The beads are of the same depth and width as before, and were found to operate successfully with 0.5 inch spacing between them. Again, regularity is not required in the angularity of the interrupted beads: a tube operated successfully where the beads, while extending about 90°, were nevertheless spaced by 1 inch, and were randomly positioned angularly with respect to one another.

FIGS. 5, 6 and 7 show an embodiment in which the desired interruption of smooth axial gas flow within tube 40 pass perforations 45 is accomplished by insertion of a screen member 47 within the tube. The screen has a rectangular mesh of mutually orthogonal strands, and is inserted into the tube with one set of strands axial and the other circumferential. As shown, in the drawings, strands 48 always contact the inner surface of the tube and extend circumferentially therearound, while strands 49 always extend lengthwise of the tube and contact strands 48 on the inner sides thereof, but woven screen may also be used. The strands need not be mutually orthogonal or orthogonal to the tube elements.

In one successful embodiment, the tube as described above and the screen was of approximately 0.06 diameter wire, with a mesh of ⅜ inch by ⅜ inch. No concern was given to where the circumferential wires lay axially with respect to the perforations: the concern is with the gas flowing along the tube, not that in the perforations.

A still further embodiment of the invention is shown in FIGS. 8 and 9. Here the tube 50, having perforations 55, is shown as being provided with a plurality of bands 60 of material conveniently of approximately the same thickness as the tube itself. The bands are preferably of such width as not to cover more than one circumferential row of holes, and are secured within the tube by any convenient method as by spot welding. In one successful embodiment, the tube was as described above, and the bands were ½ inch wide, of 18 gauge metal, and were 3.5 inches apart, the first one being 1.5 inches from the input end of the field of perforations.

From the foregoing it will be evident that we have invented a method and structure for suppressing acoustical whistles in muffler and silencer devices. By the use of our method, the inexpensive manufacturing processes of punching, forming or rolling, and welding can be used to give a basic structure which can then be treated with equal ease and economy to suppress the whistles which would otherwise appear. Regular or random beading, banding, and insertion of wire screen are procedures by which this is accomplished.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In a muffler having a gas flow passage communicating with a closed resonating chamber by sharp edged perforations aligned in the direction of gas flow, the improvement which comprises means preventing extended smooth flow of the gas past the perforations without materially restricting such flow, including an array of inward, transverse beads spaced along the passage having the perforations, in the direction of gas flow, the depth of said beads being of the same order of magnitude as the wall thickness of said passage.

2. In a muffler having a gas flow tube communicating with an enveloping resonating chamber by a field of sharp edged perforations aligned in the direction of gas flow, the improvement which comprises means preventing extended smooth flow of the gas through the tube past the perforations without materially restricting said flow, including a plurality of rings secured within said tube at locations spaced axially therealong, the thicknesses of said rings being of the same order or magnitude as the thickness of said tube.

3. In a muffler having a gas flow tube communicating with an enveloping resonating chamber by a field of sharp edged perforations aligned in the direction of gas flow, the improvement which comprises means preventing extended smooth flow of the gas through the tube past the perforations without materially restricting said flow, including a plurality of inwardly extending beads the depths of which are of the same order of magnitude as the wall thickness of said tube.

4. Apparatus according to claim 3 in which said beads have a randomly extending characteristic.

5. Apparatus according to claim 3 in which at least one of said beads is present in each length of the tube equal to the tube diameter.

* * * * *